US008393694B2

(12) United States Patent
Ha

(10) Patent No.: US 8,393,694 B2
(45) Date of Patent: Mar. 12, 2013

(54) REFRIGERATOR WITH VERTICALLY MOVING MEMBER ATTACHED TO HOME BAR DOOR

(75) Inventor: Yongsoo Ha, Changwon (KR)

(73) Assignee: LG Electronics Inc., Seoul (KR)

( * ) Notice: Subject to any disclaimer, the term of this patent is extended or adjusted under 35 U.S.C. 154(b) by 240 days.

(21) Appl. No.: 12/863,705

(22) PCT Filed: Nov. 19, 2008

(86) PCT No.: PCT/KR2008/006826

§ 371 (c)(1),
(2), (4) Date: Jul. 20, 2010

(87) PCT Pub. No.: WO2009/093801

PCT Pub. Date: Jul. 30, 2009

(65) Prior Publication Data

US 2010/0281911 A1 Nov. 11, 2010

(30) Foreign Application Priority Data

Jan. 21, 2008 (KR) ..... 10-2008-0006097

(51) Int. Cl.
*A47B 96/04* (2006.01)
*A47B 95/02* (2006.01)

(52) U.S. Cl. ..... 312/405.1; 312/319.7

(58) Field of Classification Search ..... 312/405, 312/405.1, 321.5, 319.5–319.8, 271, 272, 312/272.5, 309, 313, 315, 292, 300, 325
See application file for complete search history.

(56) References Cited

U.S. PATENT DOCUMENTS

| | | | | |
|---|---|---|---|---|
| 367,317 | A * | 7/1887 | Pease | 312/209 |
| 470,728 | A * | 3/1892 | Weiss | 223/107 |
| 2,024,436 | A * | 12/1935 | Eickmeyer | 62/267 |
| 2,131,522 | A * | 9/1938 | Peterson | 312/300 |
| 2,265,421 | A * | 12/1941 | Donnelly | 99/443 R |
| 3,643,464 | A * | 2/1972 | Hilliker et al. | 62/344 |
| 4,087,140 | A * | 5/1978 | Linstromberg | 312/292 |
| 4,174,486 | A * | 11/1979 | Winkler | 312/321.5 |
| 5,966,963 | A * | 10/1999 | Kovalaske | 62/441 |
| 6,127,752 | A * | 10/2000 | Wiesler | 310/68 B |

(Continued)

FOREIGN PATENT DOCUMENTS

| | | | |
|---|---|---|---|
| JP | 05049516 | A * | 3/1993 |
| KR | 20-0319489 | Y1 | 6/2003 |

(Continued)

OTHER PUBLICATIONS

Machine Translation of KR 2007-034330.*

*Primary Examiner* — Janet M Wilkens
*Assistant Examiner* — Andrew Roersma
(74) *Attorney, Agent, or Firm* — Birch, Stewart, Kolasch & Birch, LLP

(57) ABSTRACT

Provided is a refrigerator including a main body provided with a chilly storage, a refrigerator door rotatably coupled to the main body, a home bar at the refrigerator door, the home bar being provided with an opening, and a basket on an inside of the home bar, the basket being configured to store an object, wherein the home bar includes a home bar door rotatably provided on a side of the opening, and a driving device providing a driving force to vertically move the basket according to rotation of the home bar door. A gear assembly is operated while the home bar door is opened or closed, so that the home bar basket can easily move upward or downward.

9 Claims, 7 Drawing Sheets

U.S. PATENT DOCUMENTS

| | | | | |
|---|---|---|---|---|
| 6,199,856 | B1 * | 3/2001 | Clauser et al. | 271/180 |
| 6,247,771 | B1 * | 6/2001 | Miller | 312/310 |
| 7,127,778 | B2 * | 10/2006 | Salice | 16/354 |
| 7,254,958 | B2 * | 8/2007 | Kim et al. | 62/265 |
| 2003/0080131 | A1 * | 5/2003 | Fukuo | 220/264 |
| 2003/0122459 | A1 * | 7/2003 | Huber et al. | 312/319.6 |
| 2004/0178710 | A1 * | 9/2004 | Kim et al. | 312/405 |
| 2005/0132535 | A1 * | 6/2005 | Jang et al. | 16/357 |
| 2006/0042305 | A1 * | 3/2006 | Oh et al. | 62/407 |
| 2006/0152121 | A1 * | 7/2006 | Son et al. | 312/405 |
| 2007/0170828 | A1 * | 7/2007 | Hoshide et al. | 312/319.5 |
| 2010/0072870 | A1 * | 3/2010 | Hwang | 312/405 |

FOREIGN PATENT DOCUMENTS

| | | | |
|---|---|---|---|
| KR | 10-2004-85756 | A | 10/2004 |
| KR | 10-2007-0034330 | A | 3/2007 |
| KR | 10-0760403 | B1 | 9/2007 |

* cited by examiner

REFRIGERATOR WITH VERTICALLY MOVING MEMBER ATTACHED TO HOME BAR DOOR

TECHNICAL FIELD

The present disclosure relates to a refrigerator.

BACKGROUND ART

In the related art, a refrigerator includes a plurality of compartments for storing foods at low temperatures close to or below zero degrees Celsius. Predetermined sides of the storing compartments are opened for allowing access to the foods stored in the storing compartments.

Some of recent refrigerators include a home bar installed in a door for preventing unnecessary leakage of cold air caused by frequent opening and closing of the door.

Stored objects can be accessed through the home bar without having to open the refrigerator door. The home bar may include an opening for accessing the stores, and a home bar door to selectively cover the opening.

The home bar may further include a basket configured to receive stores.

When a user takes out stores from the basket or store stores in the basket, the user is required to bend his/her body or put his/her hand deeply into the home bar.

Especially, when taking a bottle, having a long neck, from the basket, it is required to slant the bottle such that the bottle is not caught in the opening of the home bar.

DISCLOSURE OF INVENTION

Technical Problem

Embodiments provide a refrigerator adapted such that the structure of a home bar is improved to conveniently takes out or store objects in the basket of the home bar.

Embodiments also provide a refrigerator including a device configured to raise objects stored in a home bar to a position where a user conveniently take out the objects.

Technical Solution

In one embodiment, a refrigerator includes: a main body provided with a chilly storage; a refrigerator door rotatably coupled to the main body; a home bar at the refrigerator door, the home bar being provided with an opening; and a basket on an inside of the home bar, the basket being configured to store an object, wherein the home bar includes: a home bar door rotatably provided on a side of the opening; and a driving device providing a driving force to vertically move the basket according to rotation of the home bar door.

In another embodiment, a refrigerator includes: a main body having an open front surface; a refrigerator door rotatably coupled to the main body; a home bar at the refrigerator door, the home bar being provided with an opening; and a basket at the refrigerator door, the basket being configured to store an object, wherein the home bar includes: a home bar door rotatably provided on a side of the opening, the home bar door being provided with a hinge; a plurality of gears rotated according to rotation of the home bar door; and a vertical movement device engaging with the gears and guiding the basket to vertically move.

In further another embodiment, a refrigerator includes: a main body defining an appearance; a refrigerator door rotatably coupled to the main body and provided with an opening; a home bar door rotatably coupled to a side of the opening; a vertically movable basket on a rear side of the home bar door; a movable vertical movement device coupled with the basket; and a gear assembly providing a driving force to move the vertical movement device, wherein the vertical movement device moves upward when the home bar door is opened, and moves downward when the home bar door is closed.

The details of one or more embodiments are set forth in the accompanying drawings and the description below. Other features will be apparent from the description and drawings, and from the claims.

Advantageous Effects

According to the embodiments, the gear assembly is operated while the home bar door is opened or closed, so that the home bar basket can easily move upward or downward.

Also, the home bar basket vertically moves to conveniently take out or put into stores, thereby improving user convenience.

MODE FOR THE INVENTION

Reference will now be made in detail to the embodiments of the present disclosure, examples of which are illustrated in the accompanying drawings.

Figure 1:
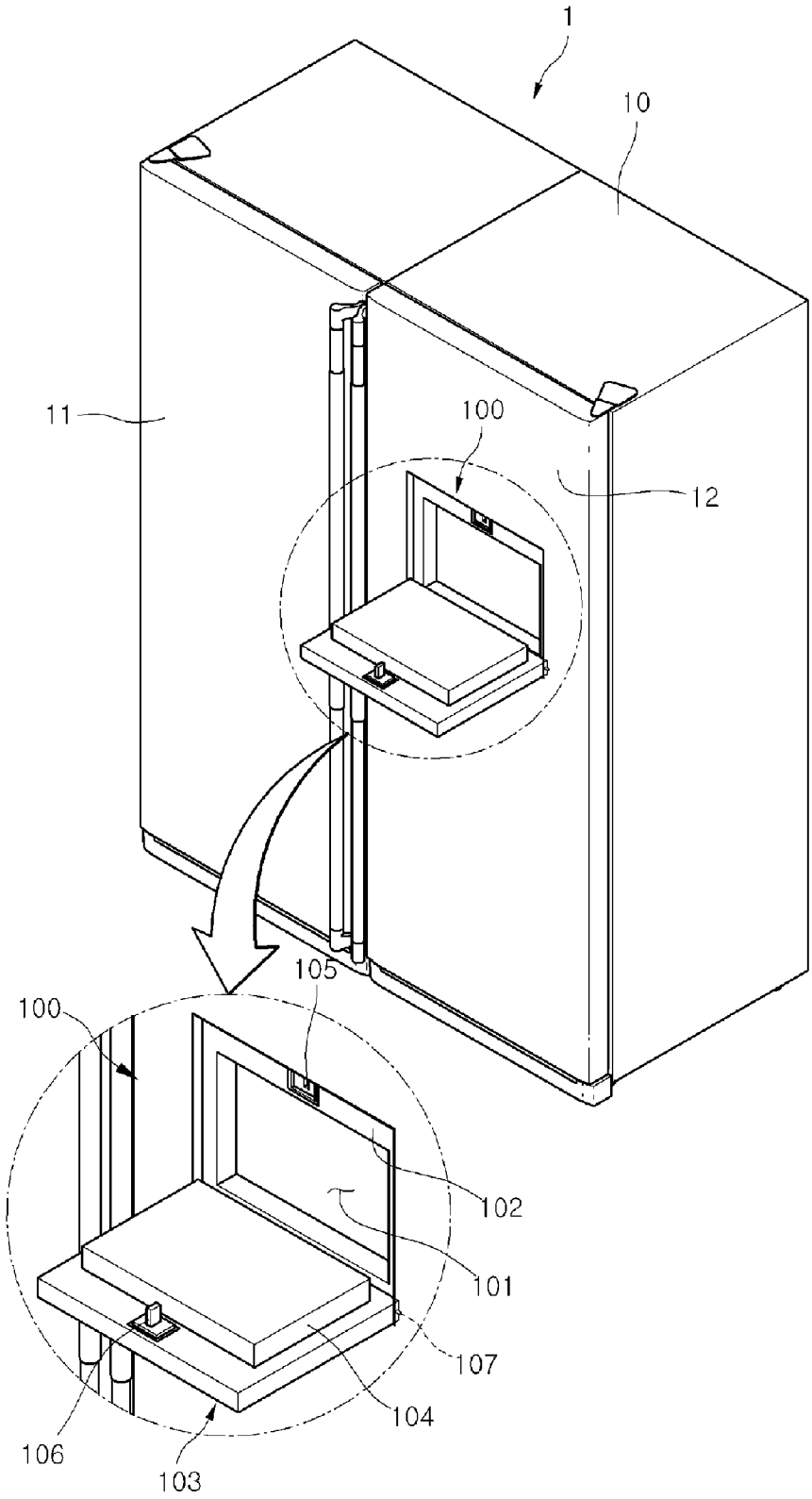
FIG. 1 is a perspective view illustrating a home bar for a refrigerator according to an embodiment.

FIG. 1 is a perspective view illustrating a home bar 100 for a refrigerator 1 according to one embodiment.

Referring to FIG. 1, the refrigerator 1 is provided with a freezer compartment (not shown) and a refrigerator compartment (not shown) and includes a main body 10 having an open front surface, a freezer compartment door 11, and a refrigerator compartment door 12. The freezer compartment door 11 and the refrigerator compartment door 12 are configured to selectively cover the front surface of the main body 10.

The refrigerator compartment door 12 includes the home bar 100 in an approximately middle thereof. The home bar 100 is configured to easily store and access frequently-used foods.

A side-by-side-type refrigerator, including a freezer compartment and a refrigerator compartment at left and right sides, will be exemplified in FIG. 1. However, positions of a freezer compartment and a refrigerator compartment are not limited thereto, and a top-mount-type refrigerator in which a freezer compartment and a refrigerator compartment are vertically arranged, or a bottom freezer-type refrigerator in which a refrigerator compartment is disposed on a top side, and the freezer compartment is disposed on a bottom side may be provided according to other embodiments.

Particularly, the refrigerator compartment of the main body 10 is configured to store foods at a refrigeration temperature ranging from about 2° C. to 5° C., and the freezer compartment is configured to store foods requiring freezing state.

Unlike FIG. 1, the home bar 100 may be provided to the freezer compartment door 11, or provided to both of the refrigerator compartment door 12 and the freezer compartment door 11.

More particularly, the home bar 100 includes an opening 101 for accessing foods, a home bar frame 102 provided to a periphery of the opening 101 and defining an appearance of the home bar 100, and a home bar door 103 configured to open or close the opening 101. Substantially, the opening 101 is disposed at the refrigerator compartment door 12.

An inner surface of the home bar door 103 is provided with a home bar door liner 104. The home bar door liner 104 comes in contact with the home bar frame 102 to seal an inner space of the refrigerator 1 in the state where the home bar door 103 covers the opening 101.

The home bar door 103 is coupled to a hinge 107 provided to a lower end of the home bar 100 and is rotatable about the hinge 107.

An inner upper portion of the home bar door 103 is provided with a latch member 106. The latch member 106 is configured to fix the home bar door 103 to the home bar frame 102 in the state where the home bar door 103 covers the opening 101.

The home bar frame 102 is provided with a latch assembly 105 catching the latch member 106 in the state of closing the home bar door 103.

The latch member 106 is inserted into and caught by the latch assembly 105 when the home bar door 103 is closed, so as to maintain the closing state of the home bar door 103. A front surface of the home bar door 103 is provided with a push part (that will be described later) configured to perform a push operation for opening the home bar door 103. Thus, the latch member 106 and the latch assembly 105, together with the push part, may be referred to as components of an "opening/closing device" for opening/closing the home bar door 103.

Figure 2:
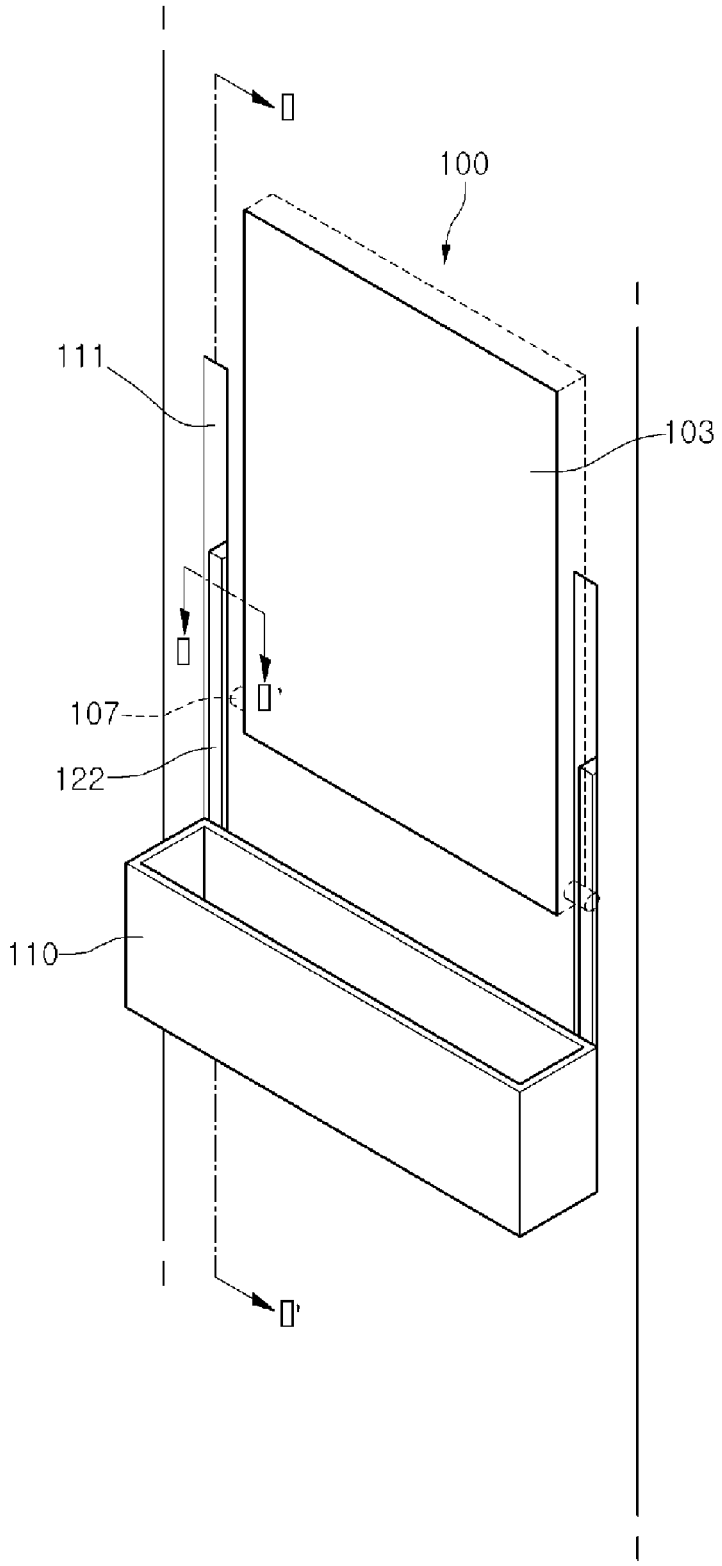
FIG. 2 is a perspective view illustrating inside configuration of a door for a refrigerator according to an embodiment.
Figure 3:
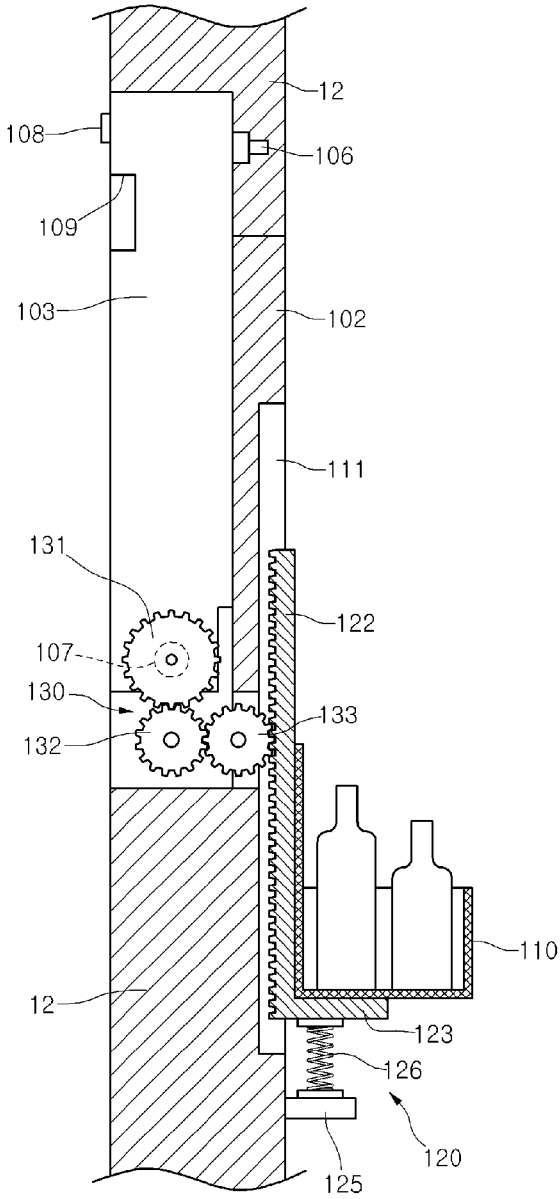
FIG. 3 is a cross-sectional view taken along line I-I' of FIG. 2.
Figure 4:
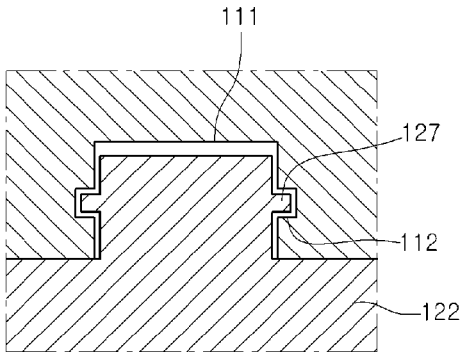
FIG. 4 is a cross-sectional view taken along line II-II' of FIG. 2.
Figure 5:
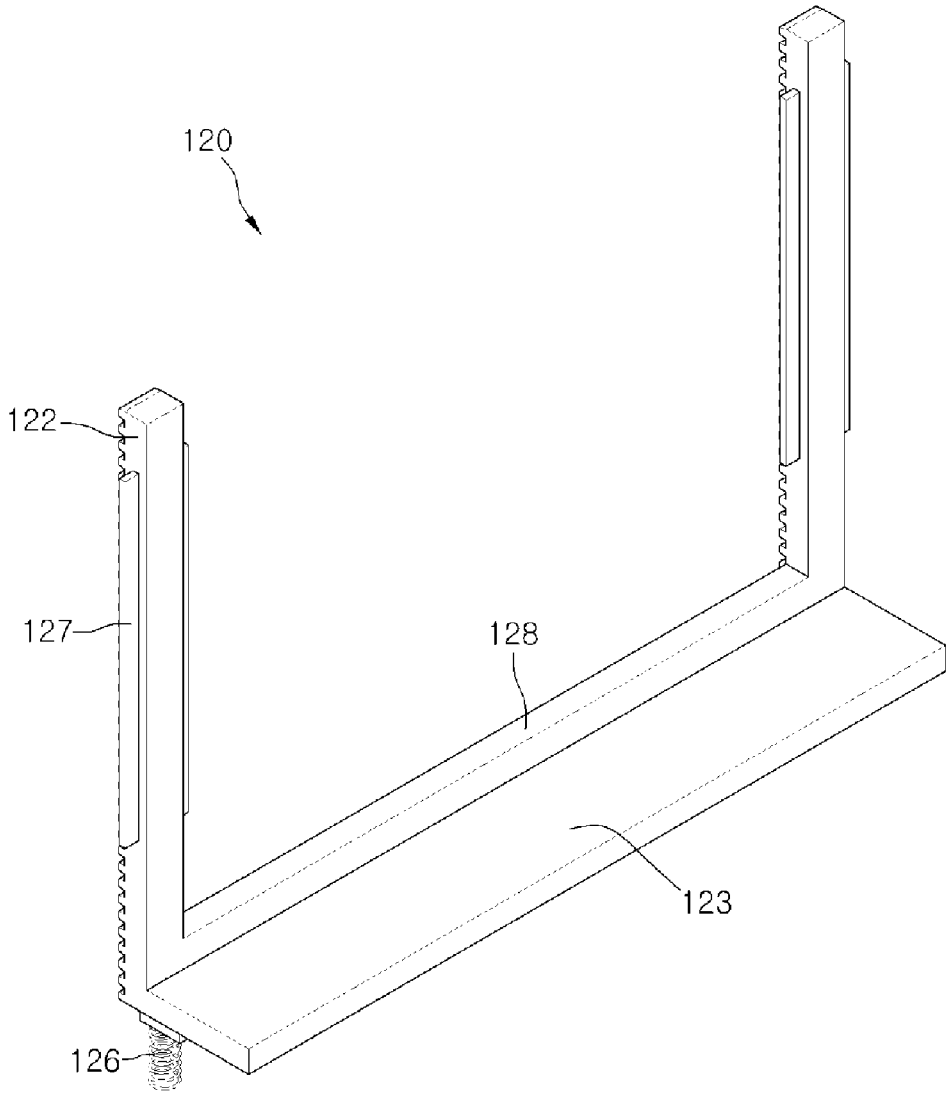
FIG. 5 is a perspective view illustrating configuration of a vertical movement device according to an embodiment.

FIG. 2 is a perspective view illustrating inside configuration of the door for the refrigerator 1 according to this embodiment. FIG. 3 is a cross-sectional view taken along line I-I' of FIG. 2. FIG. 4 is a cross-sectional view taken along line II-II' of FIG. 2. FIG. 5 is a perspective view illustrating configuration of a vertical movement device 120 according to this embodiment.

Referring to FIGS. 2 to 5, the refrigerator compartment door 12 includes a basket 110 and the vertical movement device 120. The basket 110 and the vertical movement device 120 are provided to an inner surface of the refrigerator compartment door 12. The basket 110 vertically moves according to opening and closing of the home bar door 103, and is removably coupled to the vertical movement device 120. The vertical movement device 120 guides the basket 110 to vertically move.

Particularly, the vertical movement device 120 includes a movement gear 122 vertically moving according to the opening and closing of the home bar door 103. The movement gear 122 has a vertically arranged plate shape, a side of which is provided with gear teeth.

The movement gear 122 may be provided in plurality on both sides of the home bar door 103.

One side of the movement gear 122 is provided with the basket 110. The basket 110 may move integrally with the movement gear 122.

A guide groove 111, guiding movement of the movement gear 122, is recessed in the inner surface of the refrigerator chamber door 12. The movement gear 122 may move, inserted in the guide groove 111.

The guide groove 111 is longitudinally disposed, corresponding to a movement path of the movement gear 122. A longitudinal length of the guide groove 111 may be greater than a longitudinal length of the movement gear 122 by a vertical movement range of the movement gear 122.

A left surface and a right surface of the movement gear 122 are provided with guide rails 127 inserted into the guide groove 111 and guiding the movement of the movement gear 122. The guide groove 111 is provided with recesses 112 into which the guide rails 127 are inserted.

That is, the movement gear 122 may move with the guide rails 127 inserted into the recesses 112.

The movement gears 122 are provided on both sides of the opening 101 of the home bar 100, respectively. The respective movement gears 122 are connected to each other through a connection 128 transversely disposed.

A lower end of the movement gear 122 is provided with an extending seat 123, bent approximately perpendicularly from the movement gear 122 into the main body 10. The basket 110 is placed on the seat 123.

The inner surface of the refrigerator compartment door 12 is provided with a support 125 supporting the movement gear 122 from a lower side.

A spring 126 is disposed between the seat 123 and the support 125 to support the movement gear 122 and objects stored in the basket 110.

The spring 126 may include a compression spring to support weight of objects stored in the basket 110 and to improve upward movement of the movement gear 122.

That is, the spring 126, with one side fixed to the support 125, tends to elongate upward. Thus, the movement gear 122 easily moves upward.

The kind of the spring 126 is not limited thereto, and a leaf spring or a coil spring may be used provided that the spring has a predetermined elastic force.

The hinge 107 of the home bar 100 is connected with a gear assembly 130 providing a driving force to vertically move the vertical movement device 120. The torque of the home bar door 103 may generate the driving force of the gear assembly 130.

Particularly, the gear assembly 130 includes a first gear 131 connected to the hinge 107, a second gear 132 rotatably engaging with the first gear 131, and a third gear 133 engaging with the second gear 132 and rotated according to rotation of the second gear 132.

The first gear 131 is connected to a rotation shaft of the hinge 107 and rotates in a rotation direction of the hinge 107.

The second gear 132 engages with the first gear 131, so as to rotate in an opposite direction to a rotation direction of the first gear 131. The third gear 133 rotates in an opposite direction to the rotation direction of the second gear 132.

That is, the first gear 131 may be referred to as a driving gear rotated by the rotation of the home bar door 103, and the second and third gears 132 and 133 are referred to as driven gears that rotatably engage with the first gear 131.

The third gear 133 may be disposed to engage with at least one portion of the movement gear 122. When the third gear 133 rotates, the movement gear 122 moves upward or downward, engaging with the third gear 133.

Thus, the movement gear 122 is disposed between the gear assembly 130 and the basket 110 to transmit the driving force of the gear assembly 130 to the basket 110.

The vertical movement device 120 and the gear assembly 130, which transmit the driving force to move the basket 110, may be referred to as a "driving device".

A front part of the home bar door 103 includes the push part 108 pushed to open the home bar door 103, and a handle part 109 gripped and pulled downward in the process of opening the home bar door 103. The home bar door 103 is more conveniently opened by operating the handle part 109.

Hereinafter, a process where the gear assembly 130 and the vertical movement device 120, configured as described above, vertically move the basket 110 will now be described.

Figure 6:
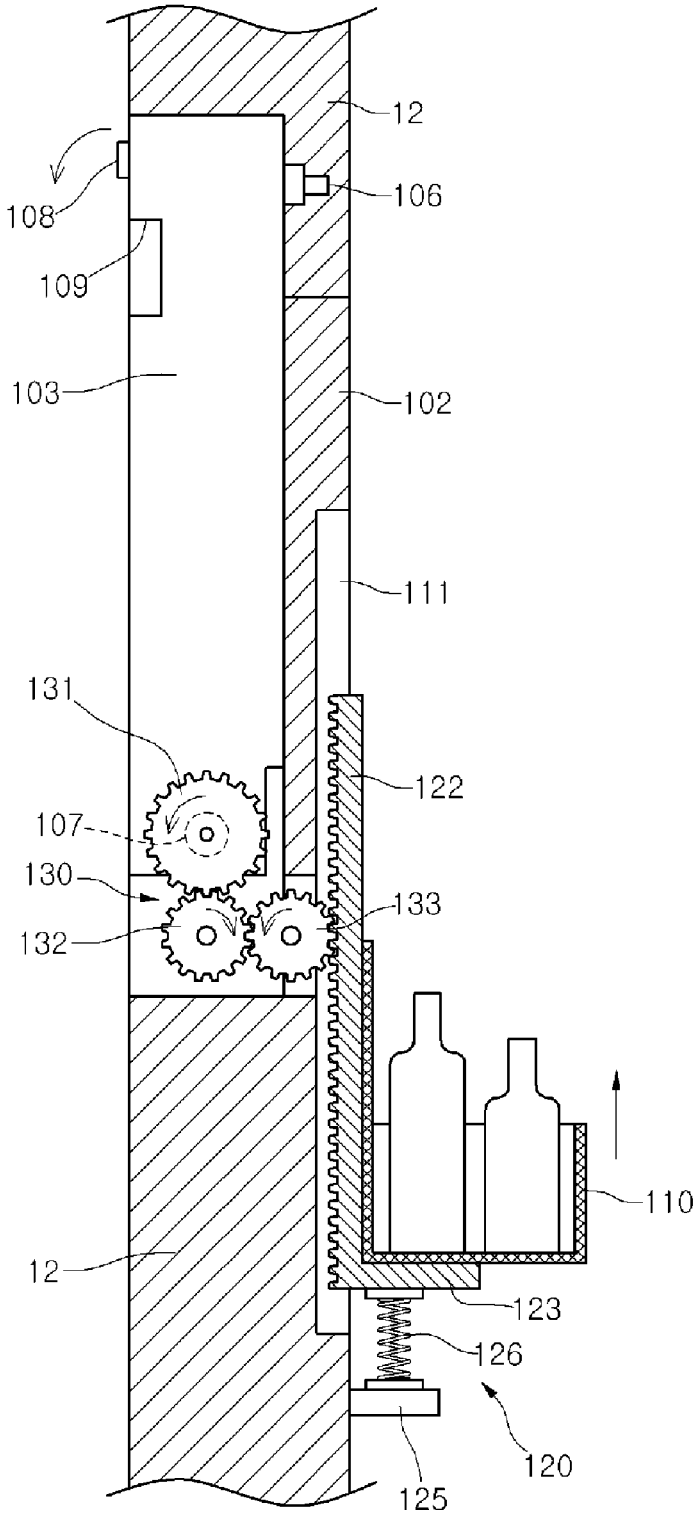
FIG. 6 is a cross-sectional view illustrating an opening process of a closed home bar door for a refrigerator according to an embodiment.
Figure 7:
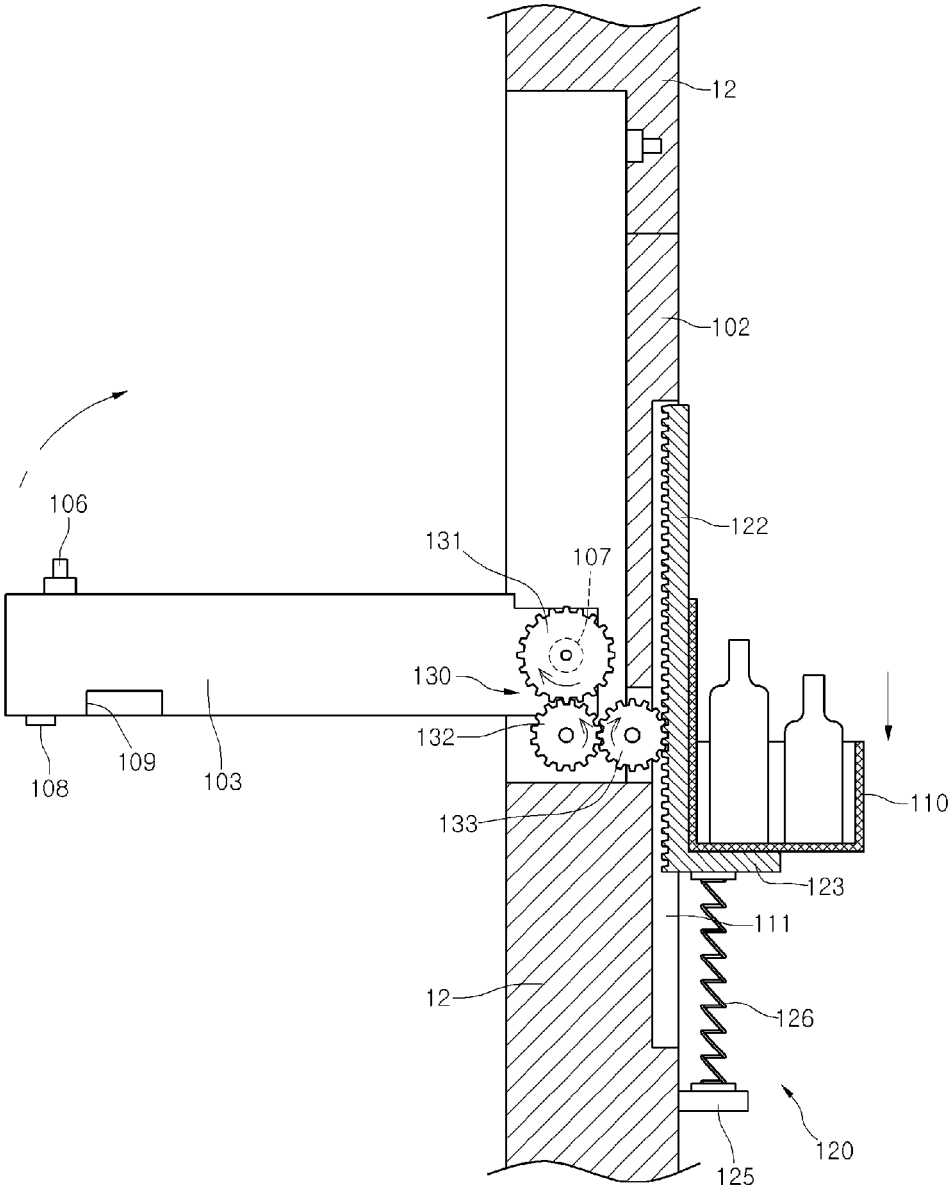
FIG. 7 is a cross-sectional view illustrating a closing process of a home bar door for a refrigerator according to an embodiment.

FIG. 6 is a cross-sectional view illustrating an opening process of the closed home bar door 103 for the refrigerator 1 according to this embodiment. FIG. 7 is a cross-sectional view illustrating a closing process of the home bar door 103 for the refrigerator 1 according to this embodiment.

Referring to FIGS. 6 and 7, the basket 110 moves upward while the home bar door 103 is opened, and downward while the home bar door 103 is closed.

Particularly, the push part 108 may be pushed to open the home bar door 103. Then, the latch member 106 is released from the latch assembly 105, and thus, the home bar door 103 is rotatable about the hinge 107.

Then, a center shaft, connecting with the hinge 107, rotates so as to rotate the first gear 131 in the same direction as that of the hinge 107. At this point, the handle part 109 may be pulled to improve the rotation of the hinge 107 and the first gear 131.

As illustrated in FIG. 6, when the home bar door 103 is opened, the center shaft of the hinge 107 rotates counter clockwise, so that the first gear 131 rotates counter clockwise.

Then, the second gear 132 rotates clockwise, engaging with the first gear 131, and the third gear 133 rotates counter clockwise, engaging with the second gear 132.

Then, the movement gear 122 moves upward, engaging with the third gear 133. At this point, the guide rails 127 are disposed in the recesses 112.

The basket 110, coupled with the movement gear 122, moves upward together with the movement gear 122.

Then, when the home bar door 103 is completely opened, an upper surface of the movement gear 122 comes in contact with an inner upper end of the guide groove 111.

As described above, the rotary motion of the gear assembly 130 is converted into the linear motion of the movement gear 122. In this process, the basket 110 vertically moves.

Therefore, while the home bar door 103 is opened, objects stored in the basket 110 move upward, and thus the objects are conveniently taken out.

On the contrary, to close the home bar door 103, the handle part 109 is gripped and the home bar door 103 is rotated clockwise (as illustrated in FIG. 7).

Then, the center shaft of the hinge 107, and the first gear 131 connecting with the hinge 107 rotate clockwise. Also, the second gear 132 rotates counter clockwise, engaging with the first gear 131, and the third gear 133 rotates clockwise, engaging with the second gear 132.

Then, the movement gear 122 moves downward, engaging with the third gear 133. At this point, the guide rails 127 are disposed in the recesses 112.

When the home bar door 103 is completely closed, the basket 110 is lowered to arrive at a storage position in the home bar 100, and to maintain the compression state of the spring 126 connected to the lower side of the movement gear 122.

According to the above described configuration, when the home bar door is opened and closed, the torque (rotary motion) of the gear assembly is transmitted to the basket, and the basket easily moves upward and downward (linear motion).

That is, the simple configuration improves the vertical movement of the basket, and a user can conveniently store objects without bending his/her body or putting his/her hand deeply into the home bar.

Hereinafter, configuration of a refrigerator will now be described according to another embodiment. Since this embodiment is the same as the previous one except for a driving motor 138 and a rotation sensor 139, the reference numerals and the description of the previous embodiment will be used.

Figure 8:
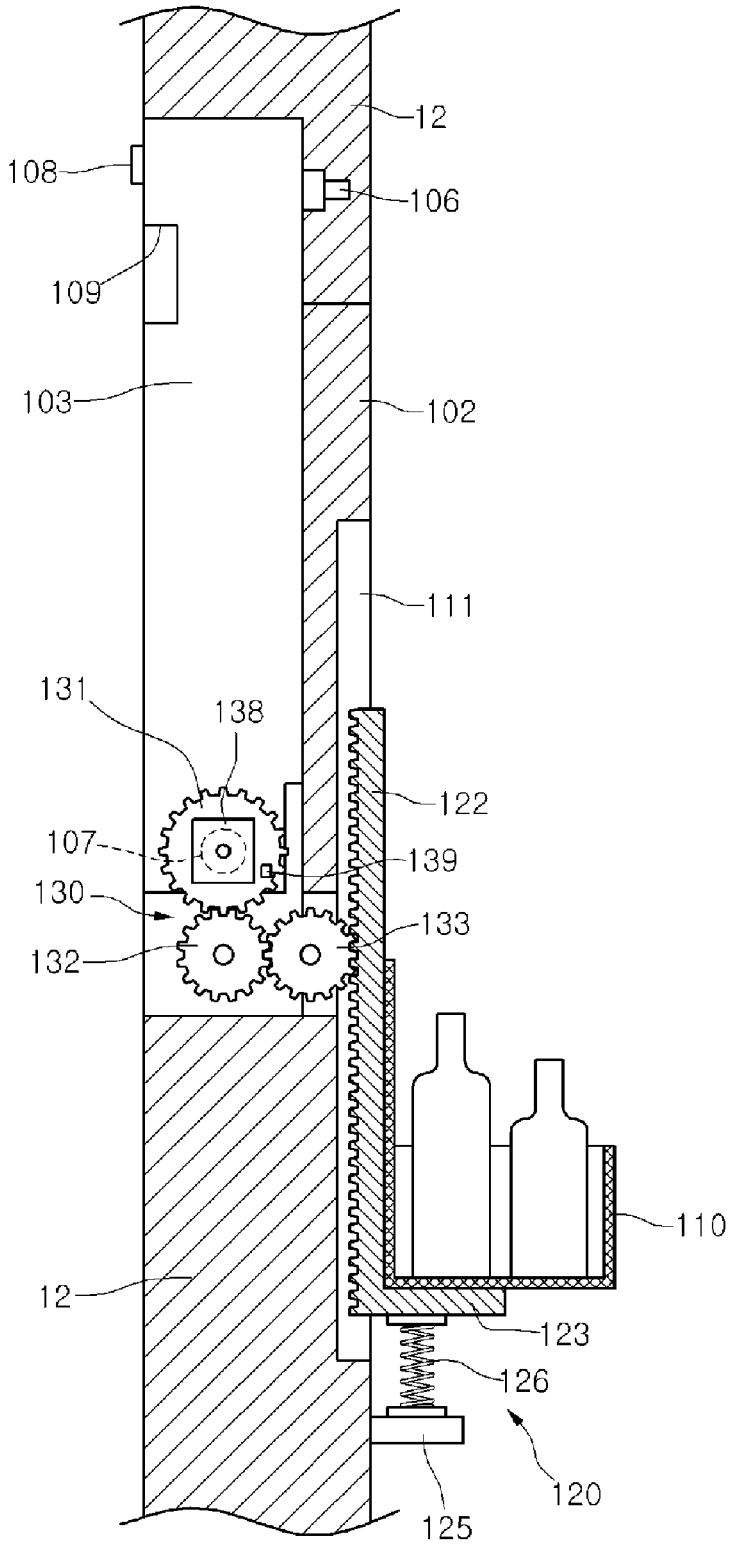
FIG. 8 is a cross-sectional view illustrating configuration of a refrigerator according to an embodiment.

FIG. 8 is a cross-sectional view illustrating the configuration of the refrigerator according to another embodiment.

Referring to FIG. 8, the gear assembly 130 may be provided with the driving motor 138 providing a driving force to rotate the first gear 131. The driving motor 138 is connected to the first gear 131 through a shaft member, so as to rotate the first gear 131.

The first gear 131 may be provided with the rotation sensor 139 sensing the rotation of the first gear 131. It is to be understood that the rotation sensor 139 may be provided to the hinge 107, so as to sense the rotation of the hinge 107.

When the home bar door 103 starts to rotate, the hinge 107 and the first gear 131 rotate in a predetermined direction, and the rotation sensor 139 senses the rotation of the home bar door 103.

Then, a signal sensed at the rotation sensor 139 may be sent to a control unit (not shown) of the refrigerator. The control unit drives the driving motor 138 to improve the rotation of the first gear 131.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the embodiments, the home bar of the refrigerator is adapted such that the vertical movement of the basket is efficiently performed according to the rotation of the home bar.

The invention claimed is:

1. A refrigerator comprising:

a main body provided with a compartment for storing foods;

a refrigerator door rotatably coupled to the main body, the refrigerator door provided with an opening and a pair of hinge holes provided at a lower part of the opening;

a home bar door hingedly coupled to the opening of the refrigerator door, the home bar door provided with a hinge shaft coupled to the hinge holes;

a first gear joined on the hinge shaft to rotate with the movement of the home bar door;

at least one second gear communicating with the first gear to rotate according to motion of the first gear;

a moving member communicating with the second gear to be vertically movable and having a rack gear which is contacted with the second gear; and a basket coupled to the moving member, wherein the basket is located under the opening within the compartment when the home bar door is closed and moves upward to be located at a height corresponding to the opening within the compartment when the home bar door is pulled down to be opened.

2. The refrigerator according to claim 1, wherein the at least one second gear includes one gear rotatable in one direction of clockwise and counter clockwise and another gear rotatable in the other direction of clockwise and counter clockwise.

3. The refrigerator according to claim 1, wherein the first gear and the at least one second gear form a gear assembly, and wherein the refrigerator further comprises a driving motor to rotate the gear assembly.

4. The refrigerator according to claim 3, wherein the gear assembly is provided with a sensor sensing rotation of the gear assembly.

5. The refrigerator according to claim 1, wherein the moving member is movably inserted into a guide groove provided at an inner surface of the refrigerator door.

6. The refrigerator according to claim 5, wherein the moving member comprises:

a guide rail inserted into the guide groove, and the guide groove is provided with a recess into which the guide rail is inserted.

7. The refrigerator according to claim 1, wherein the moving member comprises a vertically arranged plate-shaped gear.

8. The refrigerator according to claim 1, further comprising:

a seating portion coupled to the moving member on which the basket is received;

a supporting part located under the seating portion; and an elastic member disposed between the seating portion and the supporting part to provide elastic force to the basket when the home bar door is opened.

9. The refrigerator according to claim 1, further comprising:

at least another moving member; and a connecting portion connecting said moving members.

* * * * *